US006390777B1

(12) United States Patent
Kerr, Jr.

(10) Patent No.: US 6,390,777 B1
(45) Date of Patent: May 21, 2002

(54) QUICK-CONNECT FAN BLADE MOUNTING ASSEMBLY

(75) Inventor: Jack Russell Kerr, Jr., College Station, TX (US)

(73) Assignee: Angelo Fan Brace Licensing, L.L.C., Philadelphia, PA (US)

( * ) Notice: Subject to any disclaimer, the term of this patent is extended or adjusted under 35 U.S.C. 154(b) by 0 days.

(21) Appl. No.: 09/479,265

(22) Filed: Jan. 5, 2000

Related U.S. Application Data

(60) Provisional application No. 60/151,979, filed on Sep. 1, 1999.

(51) Int. Cl.[7] ..... F04D 29/34
(52) U.S. Cl. ..... 416/204 R; 416/214 R
(58) Field of Search ..... 416/204 R, 208, 416/214 R, 220

(56) References Cited

U.S. PATENT DOCUMENTS

| | | | | |
|---|---|---|---|---|
| 578,509 | A | 3/1897 | Drayton | |
| 686,211 | A | 11/1901 | Dowson | |
| 727,365 | A | 5/1903 | Holzmark | |
| 821,534 | A | 5/1906 | Perkins | |
| 871,729 | A | 11/1907 | McChord, Jr. | |
| 888,575 | A | 5/1908 | Barth et al. | |
| 1,150,241 | A | 8/1915 | Banzhof | |
| 1,479,895 | A | 1/1924 | Colby | |
| 1,485,552 | A | 3/1924 | Colby | |
| 1,935,314 | A | 11/1933 | Finch et al. | 170/162 |
| 2,040,504 | A | 5/1936 | Siegel | 230/261 |

FOREIGN PATENT DOCUMENTS

| | | |
|---|---|---|
| CA | 646509 | 8/1962 |
| DE | 1088183 | 9/1960 |
| FR | 1189060 | 9/1959 |
| GB | 8614 | of 1898 |
| GB | 10098 | of 1909 |

(List continued on next page.)

*Primary Examiner*—John Kwon
(74) *Attorney, Agent, or Firm*—Drinker Biddle & Reath LLP

(57) ABSTRACT

An assembly for quickly and easily mounting fan blades to a ceiling fan. The assembly includes a plurality of blade holders and a quick-connect mount. Each blade holder includes a coupling tongue having a locking groove located in its upper surface. The quick-connect mount is mountable to a driven part of the ceiling fan and includes a blade holder support and a cover. The blade holder support has a plurality of receivers for receiving the coupling tongues of the blade holders. The cover is rotatably attached to the blade holder support upwardly adjacent the support. The cover has a downwardly-depending skirt around its outer periphery and an annular blade lock on the surface adjacent the blade holder support. The skirt has a notch and the blade lock has a gap that are in radial alignment with each other and are selectively alignable with the receivers upon rotation of the cover and the support relative to one another. To attach a fan blade to the quick-connect mount, the cover and support are rotated relative to one another so that the notch and the gap are aligned with one of the receivers. The coupling tongue of one of the blade holders is inserted into that receiver. Then, the cover and support are rotated relative to one another so that the notch and the gap are no longer aligned with the selected receiver and the blade lock engages the locking groove in the coupling tongue.

23 Claims, 11 Drawing Sheets

U.S. PATENT DOCUMENTS

| | | | | |
|---|---|---|---|---|
| 2,290,607 | A | 7/1942 | Sensaud de Lavaud | 170/173 |
| 2,620,039 | A | 12/1952 | Allen | 170/160.6 |
| 2,908,335 | A | 10/1959 | Petty | 170/173 |
| 3,026,943 | A | 3/1962 | Huber | 170/160.59 |
| 3,071,195 | A | 1/1963 | Osmaston | 170/173 |
| 3,161,239 | A | * 12/1964 | ndersen | 416/214 |
| 3,174,553 | A | 3/1965 | Spears | 170/160.59 |
| 3,421,588 | A | 1/1969 | Saula | 170/160.59 |
| 3,452,820 | A | 7/1969 | Philipsen et al. | 170/160.59 |
| 3,656,865 | A | 4/1972 | Spears, Jr. | 416/221 |
| 3,731,515 | A | 5/1973 | Master et al. | 72/367 |
| 3,790,304 | A | 2/1974 | Langlois | 416/207 |
| 3,799,699 | A | 3/1974 | Master et al. | 416/206 |
| 3,888,601 | A | 6/1975 | Glassburn | 416/144 |
| 3,930,332 | A | 1/1976 | Seefluth | 46/75 |
| 4,140,435 | A | 2/1979 | Huber | 416/206 |
| 4,352,633 | A | 10/1982 | Tassen | 416/137 |
| 4,565,494 | A | 1/1986 | Dinger | 416/206 |
| 4,606,103 | A | 8/1986 | Koehl et al. | 29/156.8 R |
| 4,715,784 | A | * 12/1987 | Mosiewicz | 416/214 R |
| 5,072,341 | A | 12/1991 | Huang | 362/96 |
| 5,108,260 | A | 4/1992 | Monrose, III et al. | 416/142 |
| 5,180,284 | A | 1/1993 | Monrose, III et al. | 416/204 R |
| 5,354,177 | A | 10/1994 | Chang | 416/219 A |
| 5,372,480 | A | 12/1994 | Van Meter et al. | 416/214 R |
| 5,421,701 | A | 6/1995 | Funston | 415/5 |
| 5,458,465 | A | 10/1995 | von Wieser et al. | 416/214 R |
| 5,873,701 | A | 2/1999 | Shiu | 416/205 |
| 5,927,945 | A | 7/1999 | Chen | 416/5 |
| 5,944,486 | A | 8/1999 | Hodgkins, Jr. | 416/210 R |
| 5,944,487 | A | 8/1999 | Pearce | 416/244 R |
| 5,951,197 | A | 9/1999 | Wu | 403/315 |
| 5,951,253 | A | 9/1999 | Gajewski | 416/214 R |
| 5,954,449 | A | 9/1999 | Wu | 403/315 |
| 6,139,277 | A | * 10/2000 | Lopatinsky | 416/220 A |

* cited by examiner

QUICK-CONNECT FAN BLADE MOUNTING ASSEMBLY

CROSS-REFERENCE TO RELATED APPLICATION

This application is related to and claims priority from U.S. Provisional Application Ser. No. 60/151,979, filed Sep. 1, 1999.

FIELD OF THE INVENTION

The present invention generally relates to ceiling fans. More particularly, the present invention is related to apparatuses which allow fan blades to be quickly installed and removed from a ceiling fan.

BACKGROUND OF THE INVENTION

Installing a ceiling fan can be a difficult task because an installer must perform most of the installation work overhead, usually while perched on a ladder or scaffold. Generally, ceiling fans are installed with their blades removed so that the installer does not have the additional difficulty of having to reach between the fan blades, particularly when making the electrical and mechanical connections of the fan to the electrical/support box on the ceiling. After the fan has been mounted and the electrical connections have been made, the blades must be attached to the fan while it is suspended from the ceiling. This places the installer in the awkward position of working overhead, often having to install a large number of fasteners that attach the blades to the fan.

Conventional means for attaching fan blades to a ceiling fan include fan blade holders that require two or more fasteners, typically screws, per fan blade holder. Examples of such blade holders are those that are pre-attached to the fan blades and those that are pre-attached to the fan. The type that is pre-attached to the fan blade requires the installation of at least two fasteners per blade to attach the blade holder to the fan. The type that is pre-attached to the fan requires the installation of at least two fasteners per blade to attach the blade to the blade holder.

Another blade mounting means is the ring-type blade holder disclosed in U.S. Pat. No. 5,944,487 to Pearce. This type comprises a ring and a number of individual blade holders that are pre-attached to the ring. The ring includes a ring mounting portion that has a number of holes and slots for mounting to the ceiling fan. To install the fan blades to the fan, an installer must first attached each of the fan blades to the ring using two or more screws per blade. Then, the installer must attach the ring to the fan using threaded fasteners at each of the holes in the ring mounting portion. Although the installer can pre-install the blades prior to attaching the ring to the fan and although the slotted holes are used to hold the ring in place while the installer installs the remaining fasteners that attach the ring to the fan, the entire process of attaching the blades to the fan is time consuming and requires many fasteners.

Other means of mounting fan blades to a ceiling fan include the articulated blade holder and the releasable blade holder disclosed in U.S. Pat. Nos. 5,108,260 and 5,180,284, both to Monrose, III et al. The articulated blade holder allows an installer to attach the fan blades prior to lifting the fan to attach it to the ceiling. To install the fan, the blades are placed in their downward, folded position to give the installer uninterrupted access to the ceiling and portion of the fan above the blades. The releasable blade holder allows an installer to relatively easily attach the fan blades to the fan after it has been attached to the ceiling. The drawback of both of the fan blade mounting means disclosed in the Monrose, III et al. patents is that they require more parts, such as screws, springs and multi-component blade holders, than are desirable.

SUMMARY OF THE INVENTION

The present invention provides a fan blade mounting assembly, which allows a plurality of fan blades to be quickly and simply attached to and removed from a ceiling fan. The fan blade mounting assembly includes a fan blade support having an outer periphery, a plurality of receivers and a first rotational axis. The first rotational axis is located generally concentric with the outer periphery of the support. Each receiver is adapted to receive a fan blade coupling tongue. The fan blade mounting assembly further includes a blade lock having a second rotational axis. The blade lock is rotatably connected to the support such that first and second rotational axes are substantially coaxial. The lock is selectively positionable upon rotation of the lock and support relative to one another such that the blade lock selectively engages and retains a coupling tongue within the receiver in which the coupling tongue is inserted.

In one aspect of the invention, the fan blade mounting assembly further includes a cover. The support and the cover are substantially circular planar discs, each having generally horizontal inner and outer surfaces. The inner surface of the cover is located upwardly adjacent the inner surface of the support. The blade lock comprises an annular boss on the cover that projects generally in the direction of the support. The boss is selectively engageable with a locking groove located in a fan blade coupling tongue when the coupling tongue is inserted into one of the receivers. The boss includes a gap which may be selectively aligned with each of the receivers upon rotation of the cover and support with respect to one another. The notch is adapted so that a coupling tongue may be inserted into one of the receivers when the notch is aligned therewith.

In a further aspect of the invention, the cover includes a skirt located at its outer periphery. The skirt projects generally in the direction of the support and is located outwardly adjacent the outer periphery of the support. The skirt includes a notch which is substantially aligned with the gap in the boss in a direction radial to the first and second rotational axes. When the cover and the support are rotated relative to one another, the gap and the notch may be selectively aligned with each of the receivers such that a coupling tongue may be inserted into a receiver.

BRIEF DESCRIPTION OF THE DRAWINGS

For the purpose of illustrating the invention, the drawings show a form in which the invention may be embodied. However, it should be understood that this invention is not limited to the precise arrangements and instrumentalities shown.

DETAILED DESCRIPTION OF THE DRAWINGS

Figure 1:
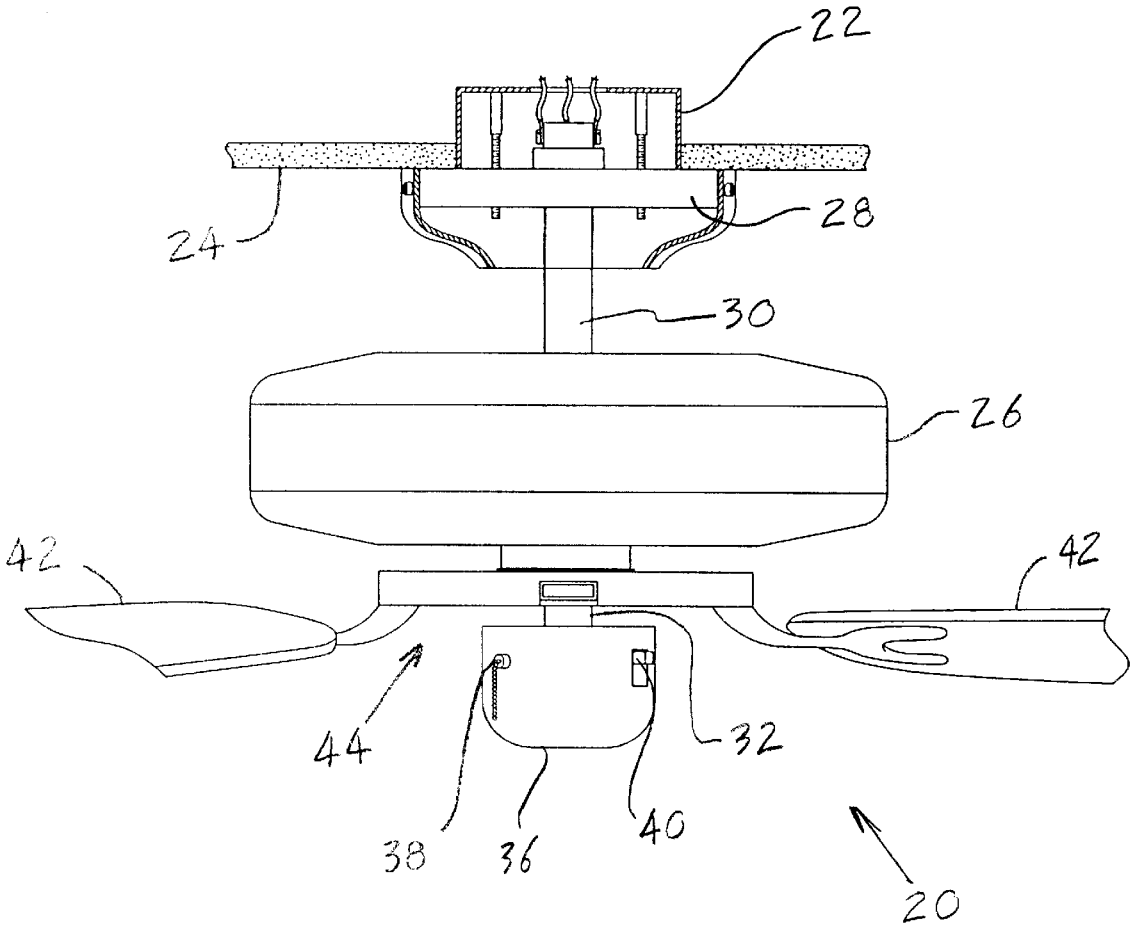
FIG. 1 is an elevational view of a ceiling fan incorporating a fan blade mounting assembly according to the present invention.
Figure 2:
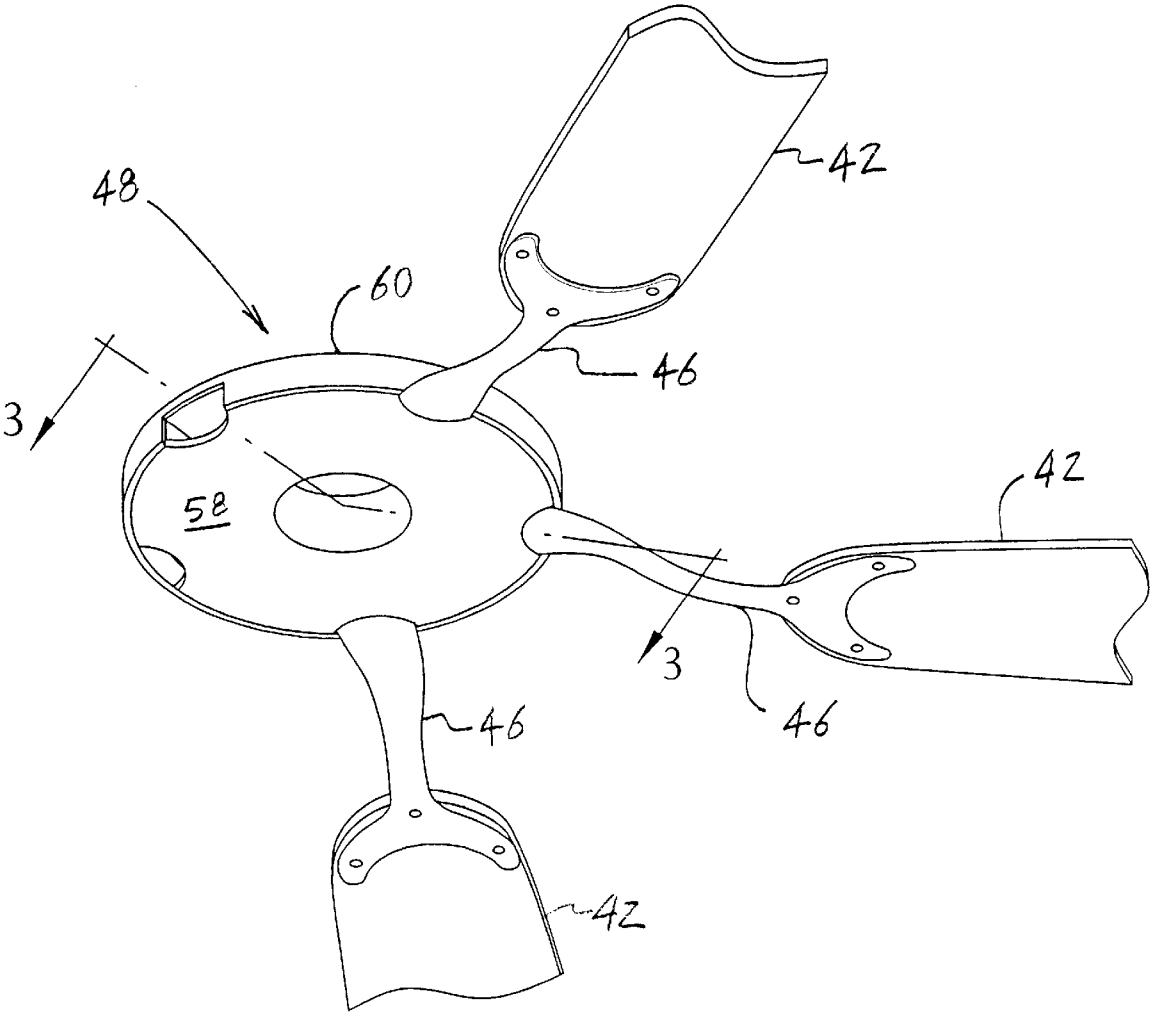
FIG. 2 is a perspective view of the quick-connect mount of the fan blade mounting assembly illustrated in FIG. 1.

Referring to the drawings, wherein like numerals indicate like elements, FIG. 1 illustrates a ceiling fan, which is designated generally by the numeral 20. The ceiling fan 20 is attached to a combination support/electrical box 22, which is mounted to a ceiling 24. The ceiling fan 20 includes a motor 26 suspended from a mounting plate 28 by a hanger tube 30, which encloses electrical wires (not shown) that run to the motor 26. A stationary shaft 32 and a driven shaft 34 (FIG. 3) depend downwardly from the motor 26. The stationary shaft 32 supports an enclosure 36 that houses an on/off switch 38 and a motor speed control switch 40. Optionally, a light fixture (not shown) may be attached to the enclosure 36. The driven shaft 34 supports fan blades 42, which are attached to the fan by a fan blade mounting assembly 44 according to the present invention. The fan blade mounting assembly 44 allows the fan blades 42 to be quickly and simply attached to and removed from the fan 20 without the use of tools for easy installation of the fan 20 and cleaning of the fan blades 42.

Figure 3:
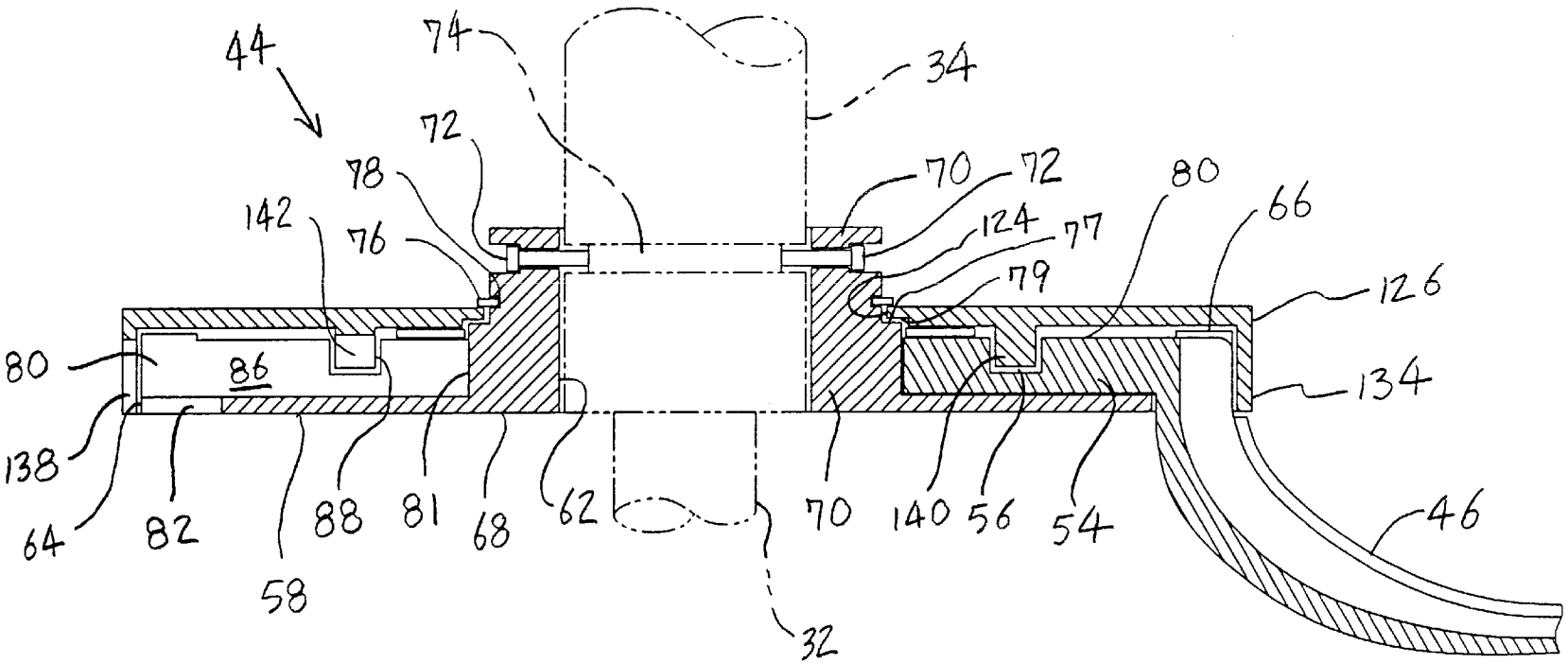
FIG. 3 is an enlarged cross-sectional view taken along line 3—3 of FIG. 2.
Figure 4:
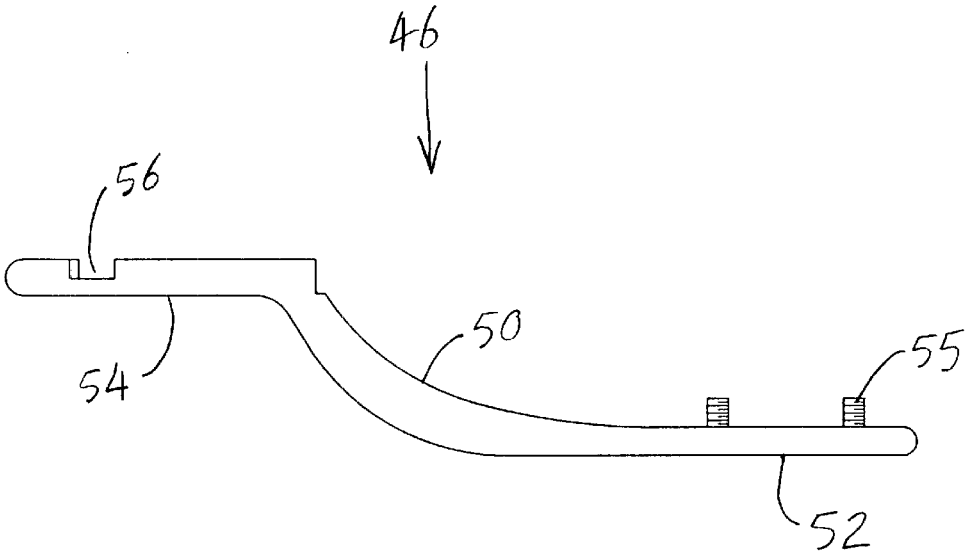
FIG. 4 is an elevational view of a blade holder usable with the fan blade mounting assembly illustrated in FIG. 1.
Figure 5:
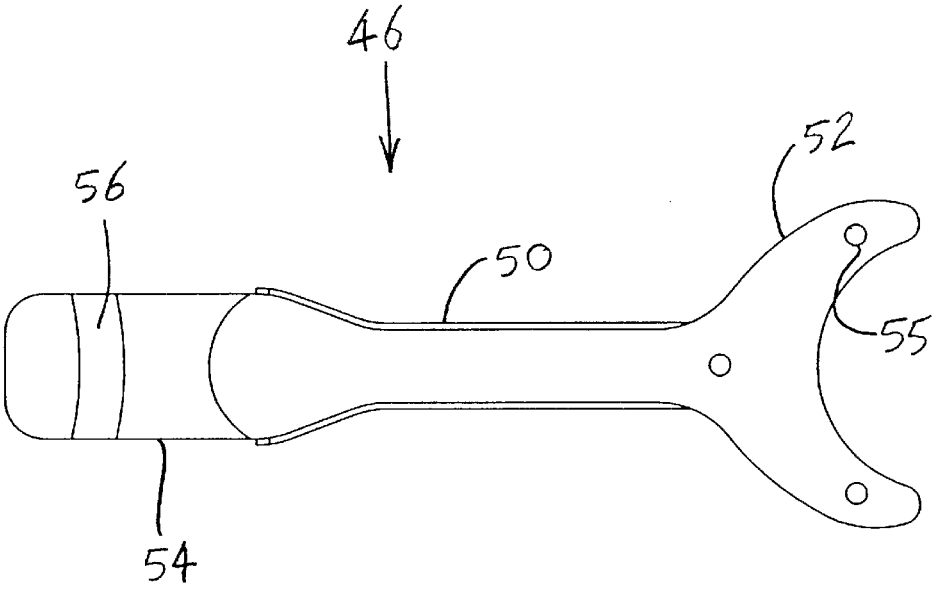
FIG. 5 is plan view of the blade holder illustrated in FIG. 4.

Referring now to FIGS. 2–5, the blade mounting assembly 44 includes five blade holders 46, shown in detail in FIGS. 4 and 5, and a quick-connect mount 48. Although a five-bladed fan is shown, the present invention may be used to support any number of blades, three to six blades being preferred. Each blade holder 46 includes an arm 50 having a blade mounting head 52 at one end and a coupling tongue 54 at the opposite end. The fan blades 42 are attached to the mounting heads 52 using fasteners, such as nuts (not shown) that engage threaded studs 55. The fan blade 42 and means for attaching it to the mounting head 52 may be any known to one skilled in the art and, therefore, need not be described in detail. The coupling tongue 54 has an arcuate locking groove 56, the function of which is described below.

The arm 50 of each blade holder 46 extends downward and outward from the quick-connect mount 48. One skilled in the art will recognize, however, that the blade mounting assembly 44 of the present invention may be readily modified for mounting top-mounted fan blades. In addition, the blade mounting assembly of the present invention may be incorporated into a unitary quick-connect mount/motor cover and, as described below, may be modified for side-mounted fan blades and mounting to a driven cover.

Figure 6:
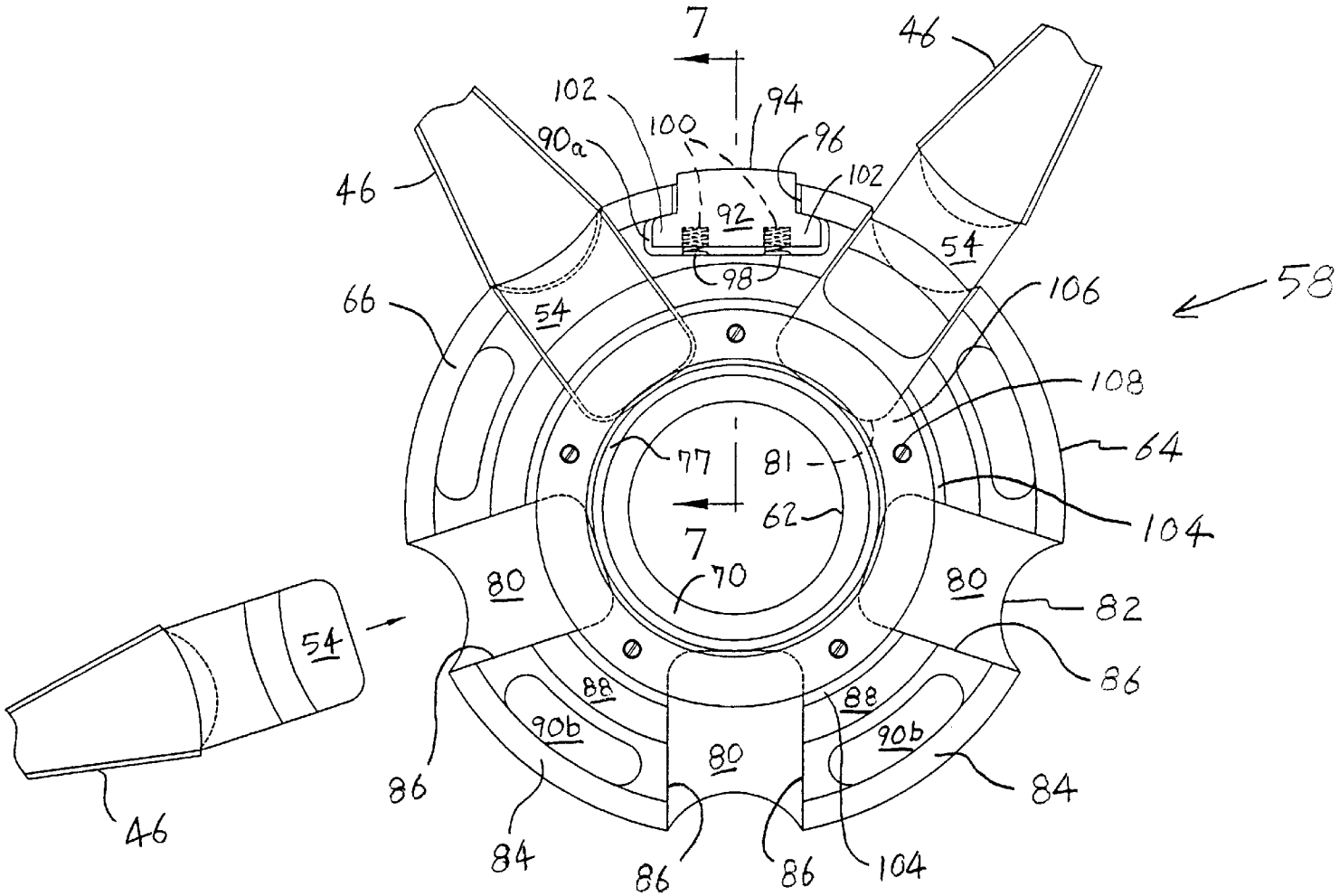
FIG. 6 is a plan view of the blade holder support of the fan blade mounting assembly illustrated in FIG. 1.

Referring now to FIGS. 3 and 6, the quick-connect mount 48 includes a blade holder support 58 and a cover 60. The blade holder support 58 is generally circular in shape and has an inner periphery 62, an outer periphery 64, an upper surface 66 and a lower surface 68. The inner periphery 62 has an annular collar 70 which projects upward from the upper surface 66. The collar 70 is provided for attaching the quick-connect mount 48 to the driven shaft 34 and for securing the cover 60 to the blade holder support 58. The quick-connect mount 48 is attached to the driven shaft 34 by four set screws 72, which threadedly engage the collar 70 and seat in an annular groove 74 around the periphery of the driven shaft 34. Other means of attaching the quick-connect mount 48 to the driven shaft 34 may be used, such as a threaded connection having a lock-nut, through-pins or the like.

A snap ring 76 located in an annular groove 78 in the collar 70 retains the cover 60 on the blade holder support 58 such that the cover 60 and blade holder support 58 may be rotated with respect to one another about a common polar axis concentric therewith. Other means for rotatably retaining the cover 60 on the blade holder support 58, such as a threaded sleeve and a locking nut which engage an externally-threaded collar, spring-loaded latch pins seated in the collar 70 or the like, may also be used.

The cover 60 bears on an annular shoulder 77 on the blade holder support 58 adjacent the collar 70. An annular recessed seat 79 mates with the shoulder 77 and keeps the cover 60 horizontally aligned with the blade holder support 58. The contact surfaces may be coated with a low friction materials such as PTFE, or, alternatively, a low friction washer may be provided between the contact surfaces.

The quick-connect mount 48 has five radial tongue receivers 80, each of which receives the coupling tongue 54 of one of the blade holders 46. In the embodiment shown, each receiver is generally a U-shaped channel that extends from an end wall 81 adjacent the collar 70 to the outer periphery 64 and has a arcuate aperture 82 extending through the lower surface 68. The aperture 82 is sized and shaped to allow the arm 50 of one of the blade holders 46 to pass therethrough when installed. Alternatively, the receivers may be channels having another shape, rods or flat bars that are sleevedly engaged by coupling tongues with like-shaped cavities, radial keys that engage longitudinal keyways in the tongues or the like.

Between each pair of adjacent receivers 80 is a segment 84 that has a pair of end walls 86 and an arcuate groove 88. Adjacent end walls 86 of adjacent segments 84 define the sides of the receivers 80. The distance between these adjacent end walls 86 is approximately equal to the width of the coupling tongues 54 to provide a snug fit therebetween. Although adjacent end walls 86 are shown as being parallel with one another, they may taper toward each other in the direction inward from the outer periphery 64.

Figure 7:
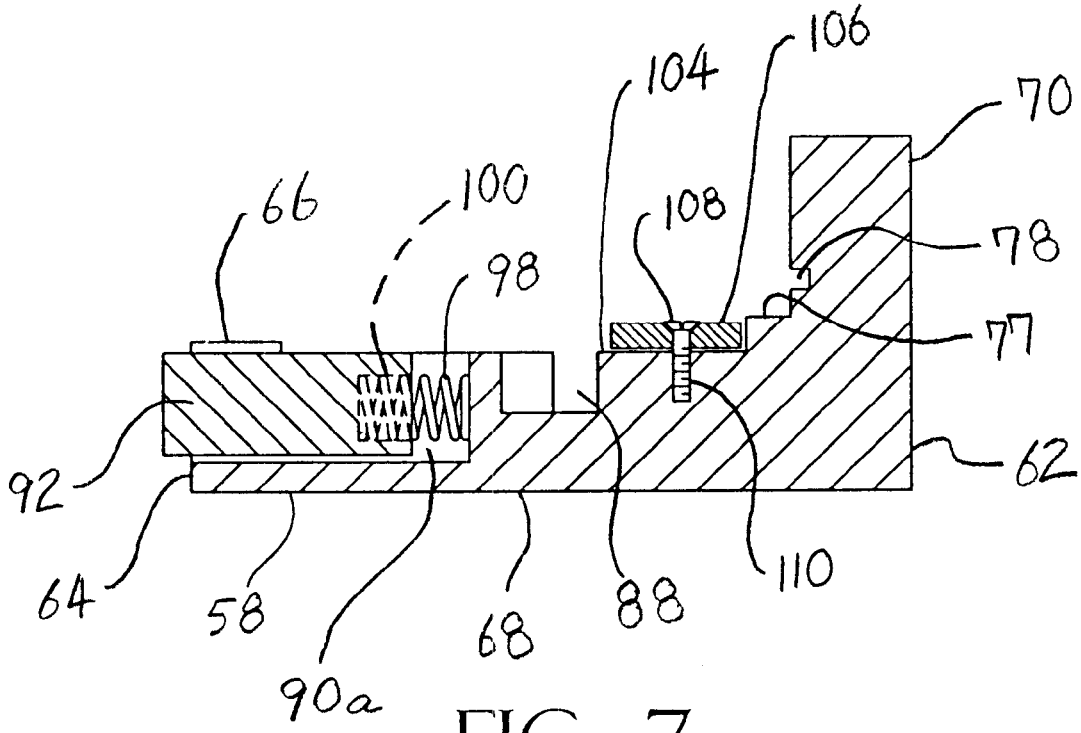
FIG. 7 is an enlarged cross-sectional view taken along line 7—7 of FIG. 6.

Recesses 90*a*, 90*b* are formed between the end walls 86 of the segments 84 and between the outer periphery 64 and the corresponding groove 88. One recess 90*a* contains a latch pin 92, and the remaining recesses 90*b* are provided to reduce the weight of the blade holder support 58. As shown in FIGS. 6 and 7, the latch pin 92 includes a head 94, which projects through an aperture 96 at the outer periphery 64 of the blade holder support 58. The latch pin 92 is biased toward the outer periphery 64 by a pair of springs 98. One end of each spring 98 is located in a seat 100 within the latch pin 92. A pair of flanges 102 limits the extent of outward travel of the latch pin 92.

Each segment 84 has a planar surface 104 which engages a retaining ring 106 located adjacent the collar 70. The retaining ring 106 is secured to each segment 84 with a countersunk screw 108 which threadedly engages a screw hole 110 in the planar surface 104. The retaining ring 106 resists the upward force of the force couple applied to the blade holder support 58 by the coupling tongue 54 that is caused by the blade holders 46 cantilevering from the blade holder support 58.

Figure 8:
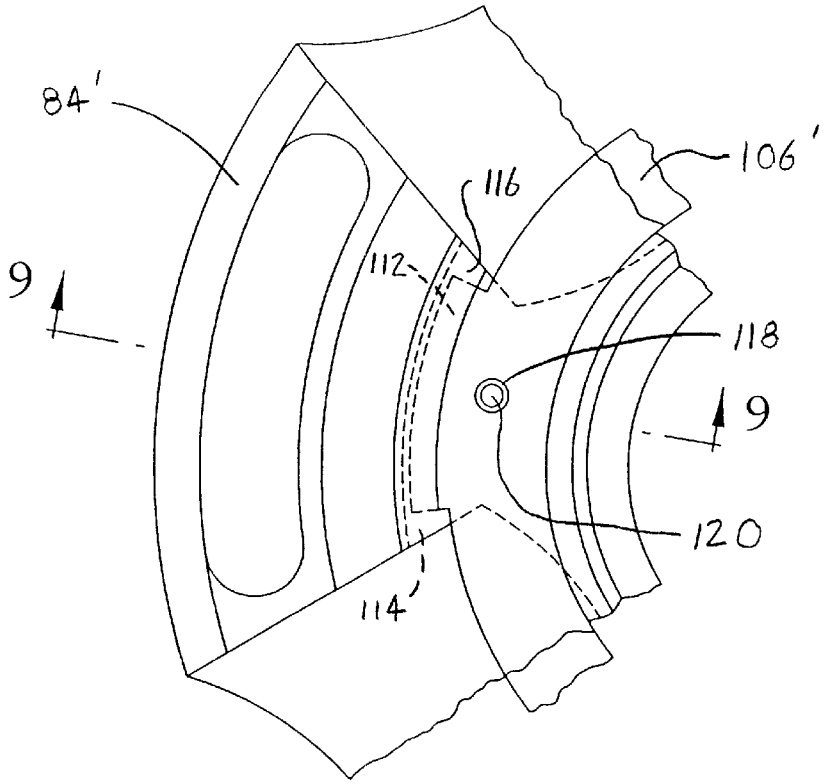
FIG. 8 is an enlarged detail of an alternative means for securing the retaining ring to the blade holder support.
Figure 9:
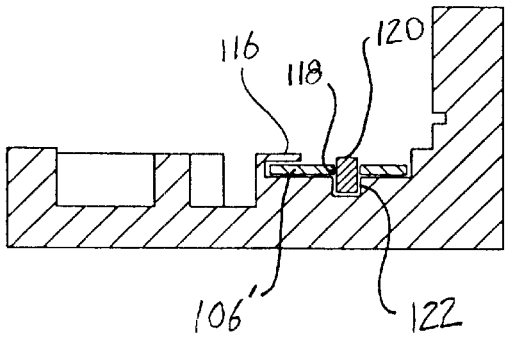
FIG. 9 is a cross-sectional view taken along line 9—9 of FIG. 8.

FIGS. 8 and 9 show an alternative retaining ring 106', which is generally annular in shape and has five tabs 112 located around its outer periphery. The tabs 112 are retained in slots 114 formed by retaining flanges 116 on the segments 84'. The retaining ring 106' contains an aperture 118 which receives a drop pin 120 that engages a seat 122 formed within one of the segments 84'. The drop pin 120 prevents the retaining ring 106' from rotating to keep the tabs 112 from disengaging the slots 114 and is retained in the seat 122 and aperture 118 by the cover when the quick-connect mount is assembled.

To install the retaining ring 106', the tabs 112 are aligned with the receivers 112' and the retaining ring 106' is brought into contact with the planar surfaces 104'. The retaining ring 106' is then rotated until the aperture 118 aligns with the seat 122. At this point, the tabs 112 are retained by the retaining flanges 116, and the drop pin 120 may be installed.

Figure 12:
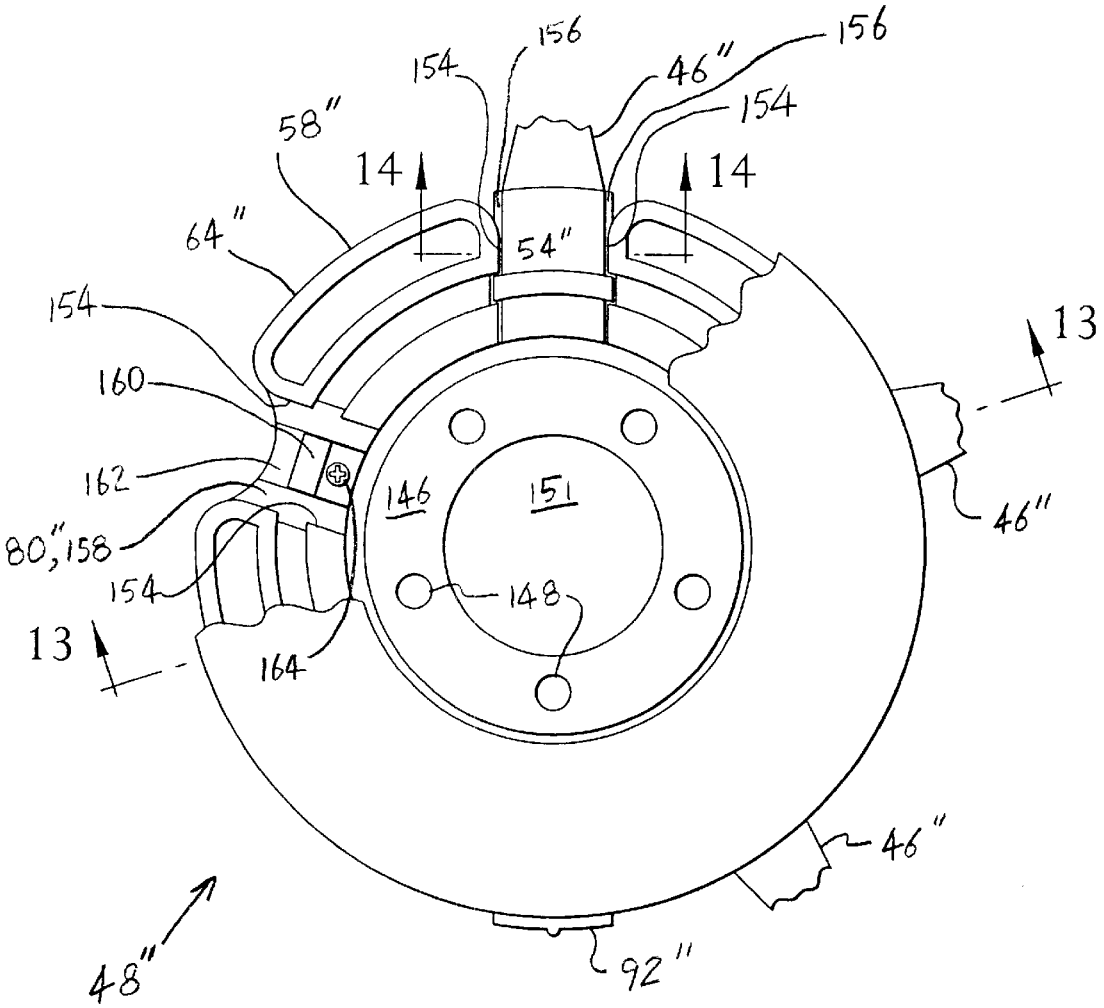
FIG. 12 is a top plan view of an alternative embodiment of a quick-connect mount according to the present invention showing the cover partially removed and three of the five fan blades installed.
Figure 13:
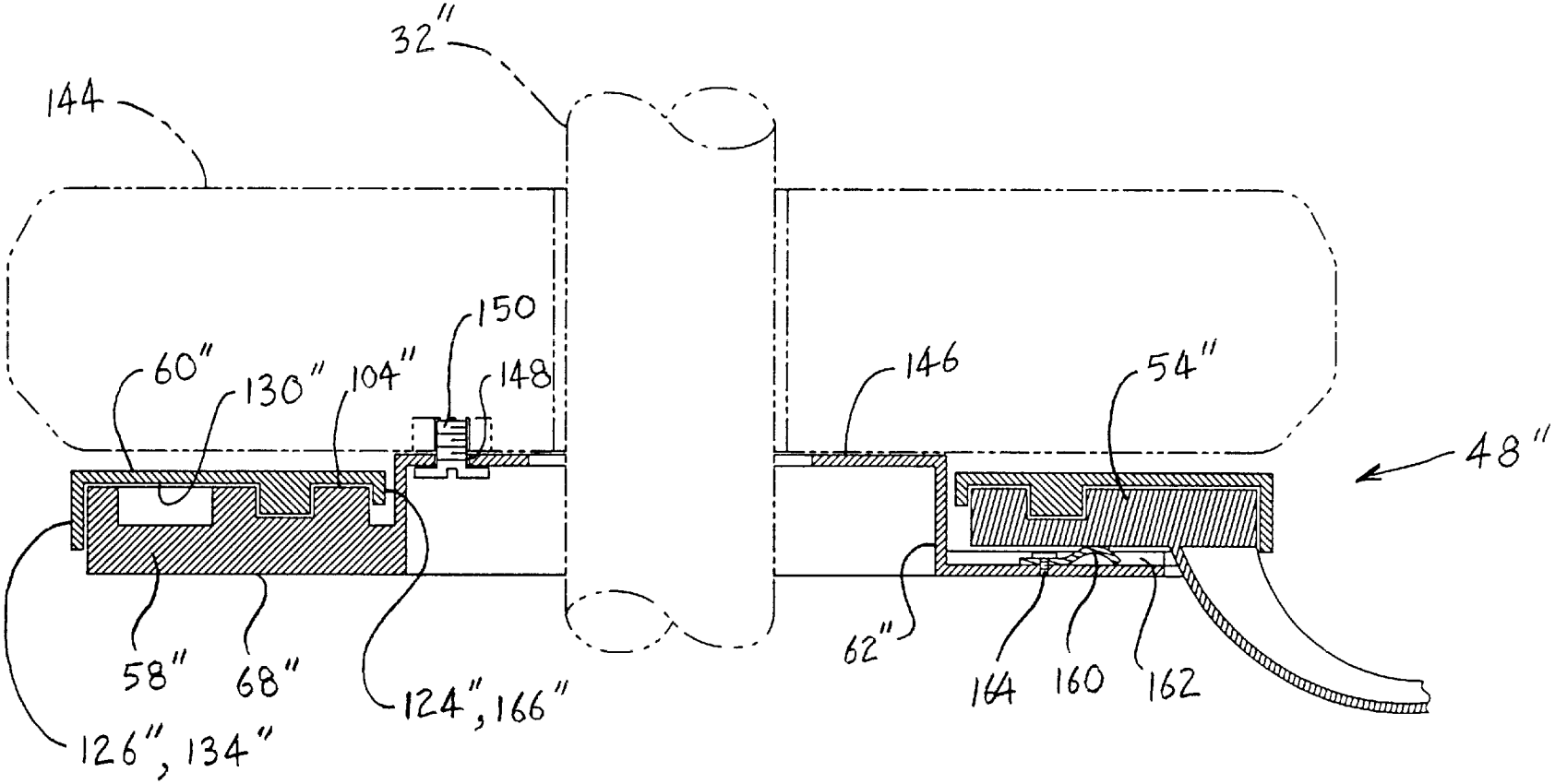
FIG. 13 is a sectional view taken along line 13—13 of FIG. 12.
Figure 14:
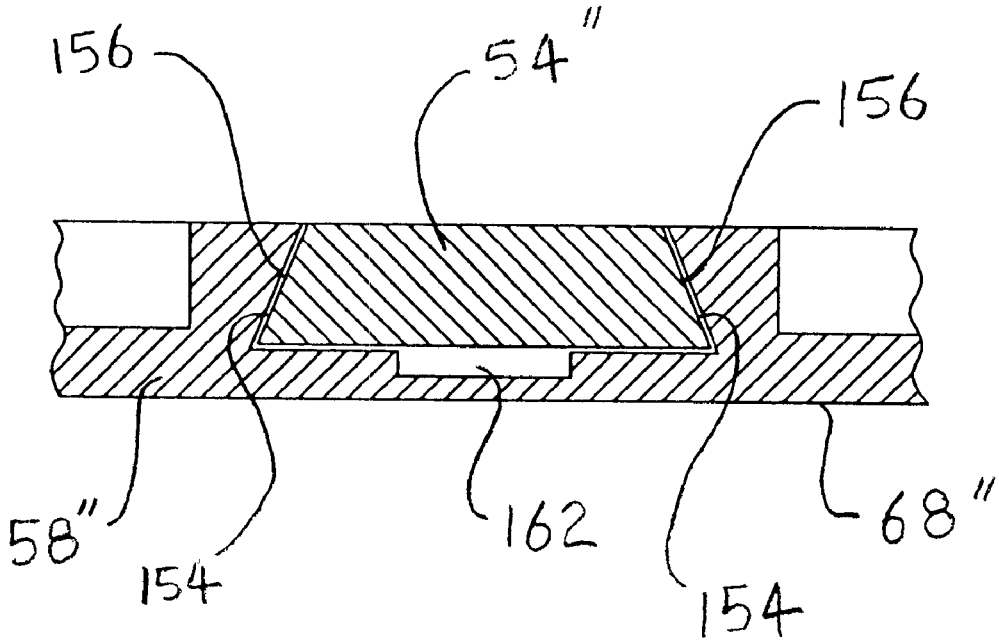
FIG. 14 is a sectional view taken along line 14—14 of FIG. 12.

Although the retaining ring may be secured to the blade holder support with screws or tabs and slots as shown, other securing means, such as welding, adhesive bonding or the like, may be used. Alternatively, the upward force from a coupling tongue may be resisted by an element other than a retaining ring. For example, a tab projecting into each receiver from the collar, a closure member which covers each receiver adjacent the upper surface of the blade holder support or the like may be provided. The upward force may also be resisted by a dovetail fit between the coupling tongues and side walls of receivers that are generally C-shaped channels, as shown in FIGS. 12–14. In addition, the cover may be used to resist the upward force at the end of the coupling tongue. One skilled in the art will recognize that there are many means that can be provided to resists the forces applied by the coupling tongue to the blade holder support and that a discussion of each is not necessary.

Figure 10:
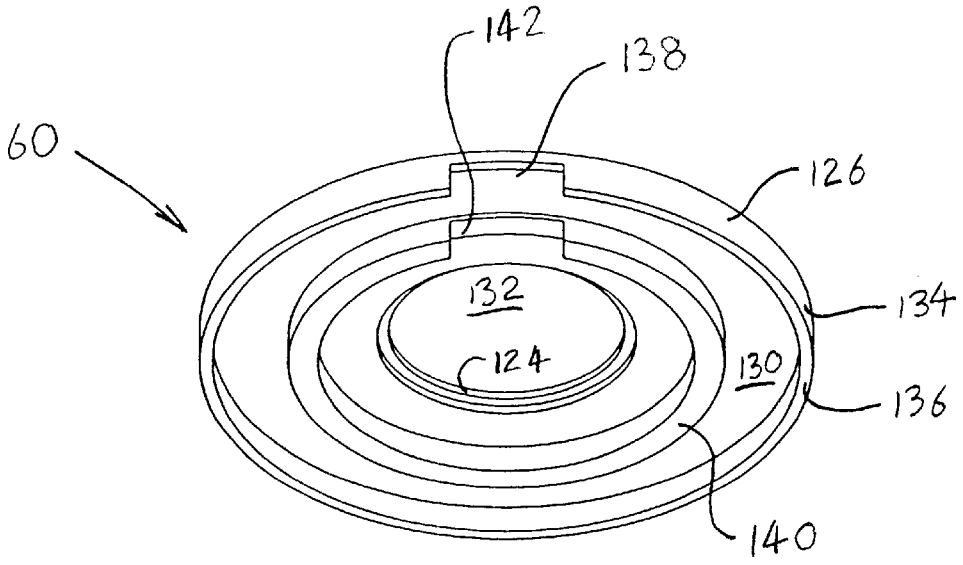
FIG. 10 is a perspective view of the lower side of the cover of the blade mounting assembly illustrated in FIG. 1.
Figure 11:
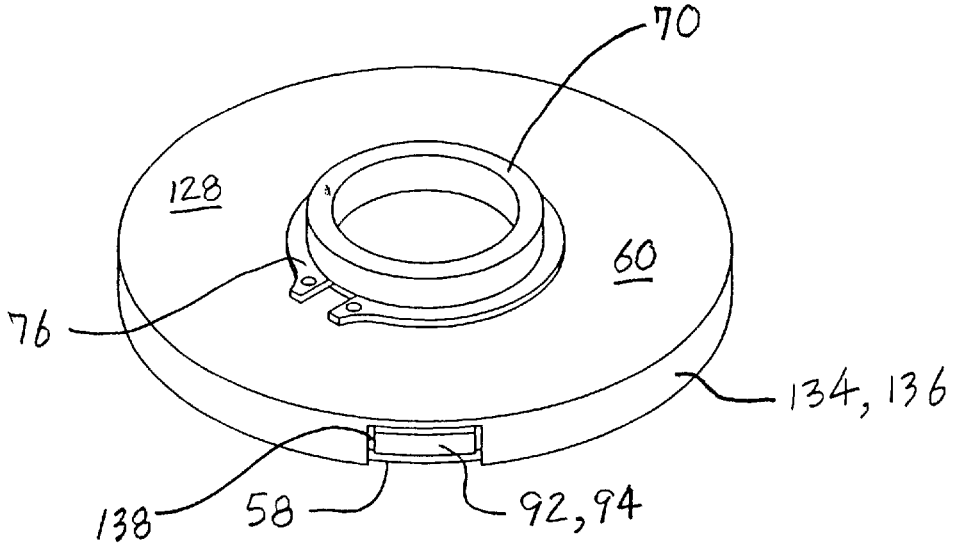
FIG. 11 is a perspective view of the quick-connect mount of the blade mounting assembly illustrated in FIG. 1.

As illustrated in FIGS. 3, 10 and 11, the cover 60 is a generally annular plate having an inner periphery 124, an outer periphery 126, an upper surface 128 and a lower surface 130. The inner periphery 124 defines an aperture 132 through which the collar 70 of the blade holder support 58 projects when the blade mounting assembly 44 is assembled as shown in FIG. 11. The diameter of the aperture 132 is selected to be slightly greater than the outside diameter of the collar 70 to allow rotation between the cover 60 and the blade holder support 58.

The outer periphery 126 of the cover 60 has a skirt 134 that depends downwardly to a lower edge 136, which is substantially flush with the lower surface 130 of the blade holder support 58. The skirt 134 has an insertion notch 138 which provides an opening that is approximately equal to the width of each receiver 80. The insertion notch 138 allows the coupling tongue 54 of one of the blade holders 46 to be inserted into one of the receivers 80 when it is aligned therewith. When the cover 60 is in its operating position, the head 94 of the latch pin 92 is located within the insertion notch 138, thereby preventing relative rotation between the cover 60 and the blade holder support 58. It is preferred that the outer face of the latch pin 92 be flush with the outer periphery 126 of the cover 60 to provide a uniform appearance of the latch pin 92 and skirt 134.

The upper surface 128 of the cover 60 is substantially planar, and the lower surface 130 has a blade lock 140 comprising an annular boss projecting downward from the lower surface 130. The blade lock 140 is continuous except for a gap 142 located in radial alignment with the insertion notch 138 in the skirt 134. The gap 142 is slightly wider than the width of the coupling tongues 54 on the blade holders 46 to allow each coupling tongue 54 to be inserted into one of the receivers 80 when the insertion notch 138 and the gap 142 are aligned with that receiver 80.

To install the fan blades 42 in the receivers 80, the following procedure is used. First, the cover 60 is rotated relative to the blade holder support 58 so that the insertion notch 138 and the gap 142 in the blade lock 140 are aligned with one of the receivers 80. The coupling tongue 54 of one of the blade holders 46 is then inserted into the receiver 80 until it contacts the end wall 81 of the receiver 80. After the coupling tongue 54 has been fully inserted, the cover 60 is rotated again until the insertion notch 138 is aligned with another receiver 80. As the cover 60 is rotated, the blade lock 140 becomes engaged with the locking groove 56 in the coupling tongue 54 so that the blade holder 46 is locked into the receiver 80. At the same time, the skirt 134 covers the open end of the receiver 80 to conceal coupling tongue 54.

When the insertion notch 138 becomes aligned with the next desired receiver 80, the coupling tongue 54 of another blade holder 46 may be inserted into that receiver 80. The insertion procedure is repeated for each of the remaining blade holders 46 and empty receivers 80. After all of the blade holders 46 have been installed, the cover 60 is rotated relative to the blade holder support 58 until the head 94 of the latch pin 92 engages the insertion notch 138 to prevent relative rotation between the cover 60 and the blade holder support 58. At this time, all of the blade holders 46 are retained by the blade lock 140 and the fan may be operated.

To disengage one of the blade holders 46 from its receiver 80, the latch pin 92 is depressed to disengage it from the insertion notch 138 so that the cover 60 can be rotated relative to the blade holder support 58. The cover 60 is then rotated so that the insertion notch 138 and gap 142 are aligned with the desired receiver 80, allowing the coupling tongue 54 to be removed therefrom.

Referring now to FIGS. 12–14 there is shown an alternative, presently-preferred embodiment of a quick-connect mount 48" according to the present invention. Like the embodiment shown in FIGS. 1–11, this embodiment includes a blade holder support 58", a cover 60" and a latch pin 92" that prevents rotation therebetween when the quick-connect mount 48" is in its operating configuration. However, instead of being adapted to mount to a driven shaft, this embodiment is adapted for mounting to a driven fan motor housing 144.

A ring mount 146, located adjacent an inner periphery 62" of the blade holder support 58", has a plurality of fastener holes 148, each of which receives a fastener 150 for fastening the quick-connect mount 48" to the motor housing 144. Although five fastener holes 148 are shown, any number may be provided. In addition, instead of circular holes, the holes may slotted, keyhole shaped or the like. For example, slotted holes would allow for variations in the pattern or diameter of the circle of fasteners. Keyhole shaped holes would allow fasteners to be partially inserted into their receptacles on the motor housing and, then, the assembly would be attached to the housing by engaging the keyed openings and rotating the assembly to engage the key slots. When the quick-connect mount 48" is in its operating position, the fasteners 150 are tightened to secure the quick-connect mount 48" in place. The mounting ring 146 defines an opening 151 that permits a stationary shaft 32' to extend therethrough. The stationary shaft may support a light fixture and/or an enclosure (not shown) that houses an on/off switch and/or a motor speed switch.

Each blade holder 48 has a coupling tongue 54" that forms a dovetail fit with a respective receiver 80" in the blade holder support 58". The dovetail fit eliminates the need for a separate retaining ring 106, 106', as shown in FIGS. 3 and 6–9. Each receiver 80" is a generally C-shaped channel 158 that extends from adjacent the inner periphery 62" of the blade holder support to its outer periphery 64". Each channel 158 has a pair of generally opposing side walls 154 that slope inward toward one another from their bottoms to tops. These sloping side walls 154 engage like-sloped surfaces 156 on each blade holder tongue 54" to form a dovetail fit. A biasing means, such as a spring clip 160, biases the blade holder tongue 54" upward to form a tight fit between the contacting surfaces to prevent blade wobble when the fan is operating. The spring clip 160 is located in a longitudinal groove 162 in the bottom of the receiver channel and is secured to the blade holder support with a threaded fastener 164. Alternatively, the spring clip may be welded, bonded or otherwise retained in its proper position. Other biasing means such as a relatively elastic material, a coil spring mounted ball bearing or the like may be used.

The cover 60" of the preferred embodiment is similar to the cover 60 shown in FIGS. 1–3, 10 and 11. However, instead of having a skirt 134" only on its outer periphery 126", the cover 60" also has a skirt 166 on its inner periphery 124" . In addition, the skirt 134" around the outer periphery 126" does not extend to the lower surface 68" of the blade holder support 58". Rather, the skirt 134" generally extends only to the bottom of the channels 158 above the longitudinal grooves 162. Although this configuration of the skirt is shown, the skirt may extend to the bottom of the blade holder support or any other location desired. For aesthetic reasons, however, it is preferable to cover at least the ends of the coupling tongues 54" adjacent the outer periphery 64" of the blade holder support 58". Because the cover 60" is sandwiched between the blade holder support 58" and the motor housing 144 when the quick-connect mount 48" is in its installed position, the cover 60" does not need to be fastened to the blade holder support 58". The lower surface 130" of the cover 60" contacts and slides on the planar surfaces 104" of the blade holder support 58". If desired, a low friction material may be provided on the contact surfaces.

One skilled in the art will recognize that there are numerous further embodiments of the fan blade mounting assembly that may be made in accordance with the present invention, several of which are described below. The described variations, however, should not be construed as encompassing the only alternative embodiments possible.

In one further embodiment, the boss and the locking grooves may be eliminated. In this case, the skirt on the cover would function as the blade lock to retain the coupling tongues in their respective receivers. Alternatively, the skirt may be eliminated. If the skirt is eliminated, the side mounted latch pin may be replaced with a top mounted latch pin seated in one of the segments and projecting through an aperture in the top of the cover. The absence of the skirt would allow the use of blade holders having arms that project radially outward from the quick-connect mount in the same plane as the receivers.

In another embodiment, the boss and skirt may be provided with a number of gaps and notches equal to the number of receivers. In this embodiment, the gaps and notches would be alignable with all of the receivers at one time to allow even more rapid engagement or disengagement of the blade holders. Once all of the blade holders have been installed, the cover would have to be rotated only a fraction of a revolution with respect to the blade holder support for the multi-notched boss to engage the locking grooves.

In yet another embodiment, the receivers may be oriented vertically within the blade support and have openings in either the upper surface or the lower surface of the blade holder support. In these embodiments, the blade holders would have vertical coupling tongues attached to the arms such that the coupling tongues and the arms generally form an L-shape. The locking groove of each coupling tongue would be located on either the radially inward side or radially outward side of the coupling tongue and engage a boss on either the skirt of the cover or a radial leg of an L-shaped projection on the cover.

Although the invention has been described and illustrated with respect to exemplary embodiments thereof, it should be understood by those skilled in the art that the foregoing and various other changes, omissions and additions may be made therein and thereto, without parting from the spirit and scope of the present invention.

I claim:

1. A fan blade mounting assembly, comprising:

a fan blade support having an outer periphery, a first rotational axis located generally concentric with the outer periphery, and a plurality of receivers located inward from the outer periphery, each receiver adapted to receive a fan blade coupling tongue; and a blade lock having a second rotational axis, the blade lock rotatably engaging the support such that the first and second rotational axes are substantially coaxial, the blade lock being selectively engageable with a fan blade coupling tongue engaged with a receiver upon rotation of the blade lock and the support with respect to one another, thereby retaining the coupling tongue.

2. The fan blade mounting assembly of claim 1 wherein the blade lock is fixedly attached to a cover having an outer periphery, the cover being rotatable about the first and second rotational axes.

3. The fan blade mounting assembly of claim 2 wherein the blade lock comprises a boss on the cover, the boss located radially inward from the outer periphery of the cover and the boss selectively engageable with a locking groove of a fan blade coupling tongue engaged with one of the receivers.

4. The fan blade mounting assembly of claim 2 wherein the blade lock comprises a skirt attached to the cover at the outer periphery of the cover.

5. The fan blade mounting assembly of claim 3 wherein the support and the cover are substantially circular discs each having inner and outer surfaces, the inner surfaces being substantially planar and located adjacent one another, the boss being located on the inner surface of the cover and projecting generally in the direction of the support, the boss being selectively engageable with a locking groove located in a fan blade coupling tongue that is engaged with one of the receivers, the boss having a gap adapted to receive a coupling tongue therethrough, the gap being selectively alignable with each of the receivers upon rotation of the support and cover relative to one another such that a coupling tongue may be engaged with one of the receivers when the gap is aligned with that receiver.

6. The fan blade mounting assembly of claim 1 wherein each receiver comprises a channel that is substantially radial to the first and second rotational axes, each channel having an opening located on the outer periphery of the support, the openings being spaced substantially equidistant from adjacent openings around the outer periphery of the support.

7. The fan blade mounting assembly of claim 4 wherein the skirt is located outwardly adjacent the outer periphery of the support and includes a notch for inserting a coupling tongue into a receiver when the notch is selectively aligned with that receiver.

8. The fan blade assembly of claim 5 further comprising a skirt attached to the cover at the outer periphery of the cover, the skirt being located outwardly adjacent the outer periphery of the support and including a notch that is in radial alignment with the gap in the boss and is adapted to permit engagement of a coupling tongue with a receiver when the notch and the gap are selectively aligned with that receiver.

9. The fan blade mounting assembly of claim 4 wherein the support and the cover are generally circular planar discs each having inner and outer surfaces, the inner surfaces being substantially planar and located adjacent one another, the skirt being located adjacent the outer periphery of the support, the skirt including an insertion notch that is selectively alignable with each of the receivers to allow engagement of a coupling tongue with the one of the receivers, the skirt being selectively positionable outwardly adjacent a coupling tongue engaged with one of the receivers.

10. The fan blade mounting assembly of claim 1 wherein the blade lock comprises an annular ring adapted to engage a plurality of locking grooves, each locking groove located in a coupling tongue of a blade holder, the ring being concentric with the first and second rotational axes and having a plurality of gaps equal to the number of receivers, each gap adapted to receive a coupling tongue therethrough, the lock having a first position wherein the gaps are aligned with the receivers and a second position wherein the gaps are located between adjacent receivers, the lock being selectively rotatable between the first and second positions.

11. The fan blade mounting assembly of claim 1 wherein each of the receivers is generally parallel to and located radially outward from the first and second rotational axes, each receiver being adapted to receive a coupling tongue of a generally L-shaped blade holder, each coupling tongue is engaged with a receiver having a pair of spaced-apart faces and a longitudinal axis generally parallel to the first and second rotational axes, the faces being generally perpendicular to a line that radiates from the first and second rotational axes and passes through the longitudinal axis of the coupling tongue, the blade lock comprising an annular ring having a gap adapted to receive a coupling tongue therethrough, the gap being selectively alignable with each of the receivers, the blade lock being selectively engageable with a locking groove in one of the faces of a coupling tongue upon rotation of the blade lock and the support with respect to one another.

12. A fan blade mounting assembly for mounting a plurality of fan blades to a ceiling fan, comprising:

a fan blade support having an inner periphery, an outer periphery, an upper face, a lower face, a first rotational axis located substantially concentric with the inner and outer peripheries of the support, and a plurality of receivers extending radially inward from the outer periphery of the support, each receiver having a channel shape adapted to receive a like-shaped fan blade coupling tongue; and a cover having an inner periphery, an outer periphery, an upper face, a lower face, a blade lock comprising a boss depending from the lower surface of the cover, the boss having a gap adapted to receive a fan blade coupling tongue therethrough, and a second rotational axis located substantially concentric with the inner and outer peripheries of the cover, the cover rotatably engaging the support such that the first and second rotational axes are coaxial and the lower surface of the cover is located adjacent the upper surface of the cover, the gap in the boss being selectively alignable with each of the receivers upon rotation of the cover and the support with respect to one another, the boss being engageable with a locking groove of a fan blade coupling tongue inserted into one of the receivers upon rotation of the cover and support relative to one another.

13. The fan blade mounting assembly of claim 12 further comprising a skirt attached to the cover at the outer periphery of the cover and depending downwardly therefrom, the skirt having a notch adapted to receive a fan blade coupling tongue therethrough, the notch being in registry with the gap in the boss.

14. The fan blade mounting assembly of claim 12 wherein the receivers are disposed radial to the support and the cover.

15. The fan blade mounting assembly of claim 14 wherein each receiver is a generally C-shaped channel and forms a dovetail fit with a like-shaped coupling tongue.

16. The fan blade mounting assembly of claim 15 further including a biasing means in the bottom of each channel for creating a substantially tight fit of the dovetail joint.

17. The fan blade mounting assembly of claim 16 wherein the biasing means is a leaf spring.

18. The fan blade mounting assembly of claim 14 wherein the support further comprises a collar attached at the inner periphery of the support and the inner periphery of the cover defines an aperture, the collar projecting upward through and beyond the upper surface of the cover.

19. The fan blade mounting assembly of claim 15 wherein the cover is rotatably retained on the support by a snap ring that engages an annular groove in the collar and is located upwardly adjacent the upper surface of the cover.

20. A fan blade mounting assembly for mounting a plurality of fan blades to a ceiling fan, comprising:

a plurality of fan blade holders, each holder including a coupling tongue having left and right side margins that are laterally spaced apart from one another, and a locking surface that extends between the left and right side margins, and a locking groove in the locking surface, the locking groove extending from the left side margin to the right side margin, the locking groove engageable with a rotational blade lock of a quick-connect mount;

a disk-shaped support having an inner periphery, an outer periphery, an upper surface, a lower surface, a plurality of receivers, each receiver comprising a generally C-shaped channel having a longitudinal axis that is substantially radial to the support and being adapted to receive the coupling tongue of one of the fan blade holders, a collar located on the inner periphery of the support and extending upward therefrom, a first rotational axis located substantially concentric with the inner and outer peripheries of the support, and a generally circular cover having an inner periphery, an outer periphery, an upper surface, a lower surface, a blade lock comprising a boss depending from the lower surface of the cover, the boss having a gap adapted to receive the coupling tongue of one of the fan blade holders, a skirt attached to the cover at the outer periphery of the cover and depending downwardly therefrom, the skirt having a notch adapted to engage the coupling tongue of one of the fan blade holders, the notch being in radial registry with the gap in the boss, and a second rotational axis located substantially concentric with the inner and outer peripheries of the cover;

the cover rotatably engaging the support such that the first and second rotational axes are substantially coaxial, the gap and the boss being selectively alignable with each of the channels upon rotation of the cover with respect to the support, the boss being engageable with the locking groove of one of the fan blade coupling tongues when that coupling tongue is inserted into one of the channels.

21. A fan blade holder usable with a quick-connect fan blade mount having a generally annular rotational blade lock, the fan blade holder comprising:

a body having a proximal end and a distal end;

a mounting head located at the distal end of the body, the mounting head for mounting a fan blade;

a coupling tongue located at the proximal end of the body, the coupling tongue having a pair of laterally spaced-apart side margins and a surface that extends from one side margin to the other, the coupling tongue insertable into a receiver of a quick-connect fan blade mount; and a locking groove located in the surface, the locking groove extending from one side margin to the other, the locking groove engageable with the rotational blade lock.

22. The fan blade holder of claim 21 wherein the surface on the coupling tongue is substantially planar.

23. A fan blade usable with a quick-connect fan blade mount having a generally annular rotational blade lock, the fan blade comprising:

a coupling tongue having left and right side margins laterally spaced apart from one another and a surface that extends between the left and right side margins, the coupling tongue for inserting into a receiver of a quick-connect fan blade mount; and a locking groove in the surface, the locking groove extending from the left side margin to the right side margin, the locking groove engageable with the rotational blade lock.

* * * * *